US009474333B2

(12) United States Patent
Iannello et al.

(10) Patent No.: US 9,474,333 B2
(45) Date of Patent: Oct. 25, 2016

(54) REPAIRABLE BUCKLE

(71) Applicant: ILLINOIS TOOL WORKS INC., Glenview, IL (US)

(72) Inventors: Christopher A. J. Iannello, Rollings Meadows, IL (US); Martin J. Nilsen, Hampshire, IL (US); Michael B. Grimm, Evanston, IL (US)

(73) Assignee: ILLINOIS TOOL WORKS INC, Glenview, IL (US)

( * ) Notice: Subject to any disclaimer, the term of this patent is extended or adjusted under 35 U.S.C. 154(b) by 0 days.

(21) Appl. No.: 14/590,198

(22) Filed: Jan. 6, 2015

(65) Prior Publication Data

US 2015/0208768 A1 Jul. 30, 2015

Related U.S. Application Data

(60) Provisional application No. 61/932,869, filed on Jan. 29, 2014.

(51) Int. Cl.

| | |
|---|---|
| ***A44B 11/00*** | (2006.01) |
| ***A44B 11/25*** | (2006.01) |
| ***A44B 11/26*** | (2006.01) |

(52) U.S. Cl.

CPC ..... *A44B 11/2592* (2013.01); *A44B 11/266* (2013.01); *Y10T 24/40* (2015.01)

(58) Field of Classification Search

CPC ..... A44B 11/006; A44B 11/005; A44B 11/2546; A44B 11/2553; A44B 11/2592; A44B 11/26; A44B 11/266; A44B 11/18; A44B 11/10; A44B 11/04; A44B 11/263; Y10T 24/40

USPC ..... 24/163 R, 193, 196, 200, 614, 615, 24/265 EC

See application file for complete search history.

(56) References Cited

U.S. PATENT DOCUMENTS

| | | | | | |
|---|---|---|---|---|---|
| 4,454,675 | A * | 6/1984 | Ives | F41C 23/02 | 42/85 |
| 4,841,658 | A * | 6/1989 | Katsenes | F41C 23/02 | 42/85 |
| 5,067,267 | A * | 11/1991 | Ives | F41C 23/02 | 224/150 |
| 5,074,069 | A * | 12/1991 | Shire | F41C 23/02 | 42/85 |
| 5,915,630 | A * | 6/1999 | Step | E04H 15/64 | 24/115 H |
| 6,292,983 | B1 * | 9/2001 | Giaquinta | A44B 11/006 | 24/163 R |
| 6,536,154 | B1 * | 3/2003 | Norris | A44B 11/006 | 24/2.5 |
| 7,654,028 | B1 * | 2/2010 | Grover | F41C 23/02 | 224/150 |
| 2003/0145435 | A1 * | 8/2003 | Carver | A44B 11/04 | 24/115 F |

FOREIGN PATENT DOCUMENTS

| | | | | |
|---|---|---|---|---|
| AU | WO 2014019009 A2 * | 2/2014 | ..... | A44B 11/006 |

* cited by examiner

*Primary Examiner* — Robert J Sandy
*Assistant Examiner* — Rowland Do
(74) *Attorney, Agent, or Firm* — Paul F. Donovan

(57) ABSTRACT

A latching buckle assembly wherein one buckle component includes a removable cross-bar adapted to receive an attachment strap in looped relation. The cross-bar is adapted to hold the attachment strap in place during use while permitting free relative rotation. When the cross-bar is removed, the webbing can be disengaged from the buckle member to facilitate replacement if required.

8 Claims, 4 Drawing Sheets

REPAIRABLE BUCKLE

CROSS REFERENCE TO RELATED APPLICATIONS

The present non-provisional United States Patent Application claims the benefit of, and priority from, U.S. Provisional Application 61/932,869 filed on Jan. 29, 2014. The contents of such referenced application are hereby incorporated herein by reference in their entirety.

TECHNICAL FIELD

The present disclosure relates generally to buckles which are operatively connected to support surfaces such as backpacks, clothing and the like by the use of looped connection straps.

BACKGROUND

Two-piece buckles that snap together and latch automatically upon adequately inserting a male component into a female component are known and are used in a variety of applications. In past constructions, one of the members (typically the female member defining the buckle body) includes an eyelet with a fixed cross-bar positioned at a distal end located away from the connection point to the other member. A short piece of webbing is looped through the eyelet and the free ends of the webbing are then stitched or otherwise connected to a support surface such as a backpack, article of clothing or other structure. A secure connection between the buckle member and the support surface is thereby established.

The use of a buckle member of unitary construction with a webbing connection sewn to a support surface provides an excellent connection during use. However, in the event that the buckle member is damaged, replacement of the damaged part requires that one end of the webbing to be cut or otherwise detached from the support surface for rethreading through a replacement buckle member. The free end of the webbing must then be reattached to the support surface. This replacement procedure is thus time consuming and requires substantial skill. Accordingly, a buckle assembly which provides secure attachment during use, while nonetheless facilitating ease of replacement would represent a significant advancement over the current art.

SUMMARY OF THE DISCLOSURE

The present disclosure provides advantages and alternatives over the prior art by providing a latching buckle assembly wherein one buckle component includes a removable cross-bar adapted to receive an attachment strap in looped relation. The cross-bar is adapted to hold the attachment strap in place during use. When the cross-bar is removed, the webbing can be disengaged from the buckle member to facilitate replacement if required.

In one aspect thereof, the present disclosure provides a buckle assembly including a receiving body component and a latch component adapted for insertion into the receiving body component. At least the body component comprises a first upstanding ear and a second upstanding ear disposed in spaced-apart relation from one another on opposing lateral sides of the buckle component. The first upstanding ear comprises an entrance opening and the second upstanding ear comprises an exit opening disposed in substantially aligned relation to the entrance opening. A displaceable pin extends matedly through the entrance opening and the exit opening such that the displaceable pin defines a removable cross-bar extending in spanning relation between the first upstanding ear and the second upstanding ear at an elevation such that an attachment strap may be disposed in looped relation to the displaceable pin such that the receiving body component is rotatable relative to the attachment strap.

Other features and advantages of the disclosure will become apparent to those skilled in the art upon review of the following detailed description, claims and drawings in which like numbers are used to designate like features.

Figure 1:
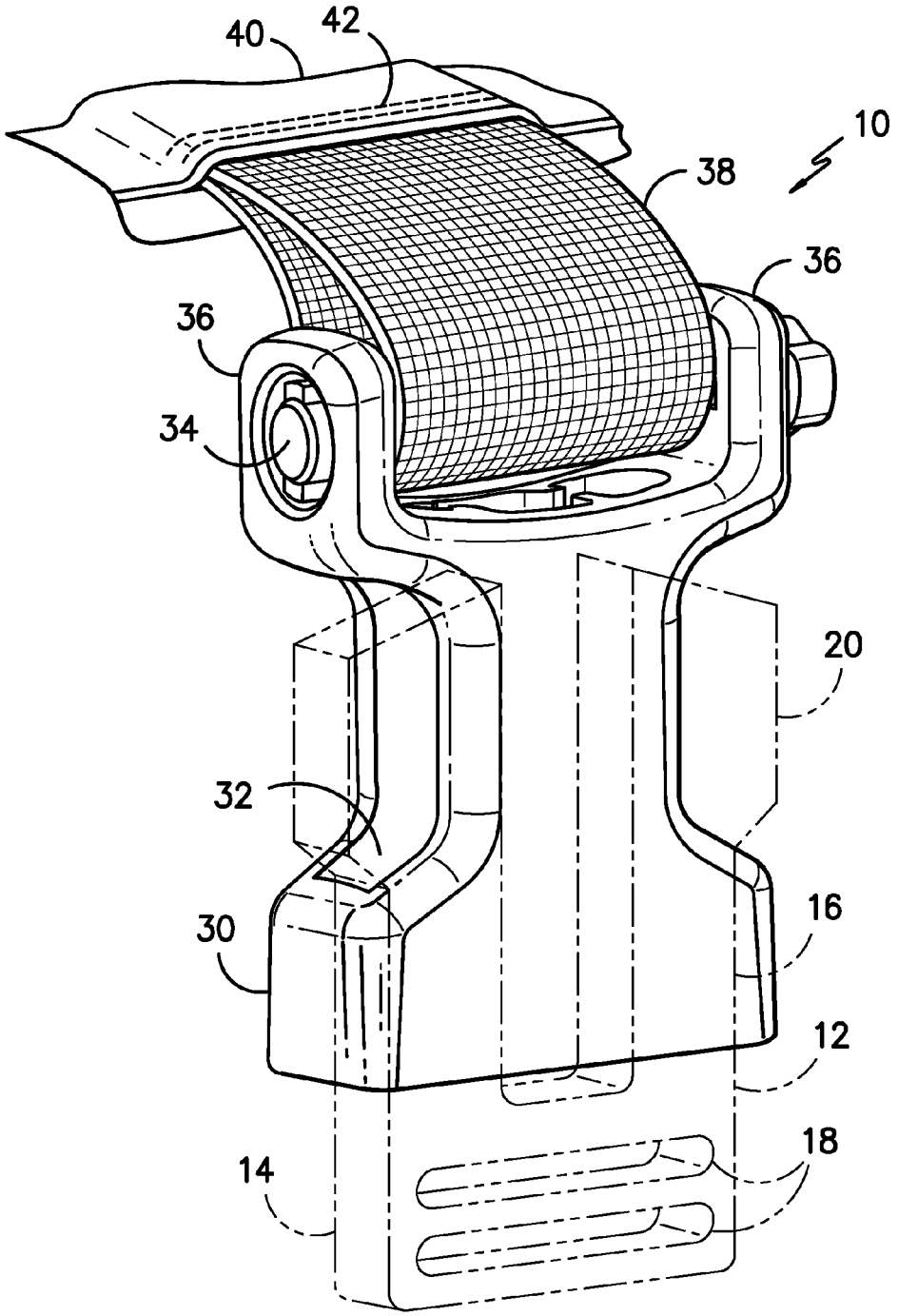
FIG. 1 is a schematic perspective view illustrating an exemplary buckle assembly consistent with the present disclosure.

Before the embodiments of the intention are explained in detail, it is to be understood that the disclosure is not limited in its application to the details of construction and the arrangements of the components set forth in the following description or illustrated in the drawings. The disclosure is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENTS

Referring now more specifically to the drawings and to FIGS. 1-4 in particular, a buckle 10 in accordance with the present disclosure is shown. As illustrated, the exemplary buckle 10 includes a male latch component 12 having a proximal base 14 and a pair of flexible distal legs projecting away from the proximal base 14. As shown, the proximal base 14 may include a pair of eyelets 18 for connection to a adjustable strap (nor shown) in a manner as will be well understood by those of skill in the art. The distal legs 16 may each include a lateral shoulder feature 20 for use in establishing a snap connection within a hollow receiving body 30. As shown, in the illustrated exemplary construction, the receiving body 30 includes a pair of lateral openings 32 on opposing sides for receipt of the lateral shoulder features 20 on the distal legs 16. The receiving body 30 also includes a cross-bar generally designated as 34 extending between a pair of upstanding ears 36. The cross-bar 34 engages an attachment strap 38 of fabric or the like in looped relation.

The male latch component 12 and the female receiving body 30 and cross-bar 34 each can be made as individual monolithic structures of plastic formed by injection molding processes, or the like. However, it is likewise contemplated that other materials of construction such as metals or the like may be used to form one or more of the components if desired. By way of example only, and not limitation, exemplary polymeric construction materials may include Nylon 6, Nylon 6.6 and ABS. However, virtually any other moldable plastic with adequate strength may be used.

As shown, the attachment strap 38 may be connected in fixed relation to a support structure 40 such as the surface of a backpack, article of clothing or the like. By way of example only, and not limitation, the attachment strap 38 may be held in place at the support structure 40 by stitching 42 or other connection means as will be well known to those of skill in the art.

During use, the distal legs 16 may be inserted into, and received by, the hollow receiving body 30 such that the lateral shoulder features 20 project through the lateral openings 32 of the receiving body, whereby the buckle 10 is latched. Due to the presence of the attachment strap 38 in looped relation to the cross-bar 34, an operative connection is established between the support structure 40 and any strap or other structure which may be connected to the latch component 12. The relatively lose looped relation between the attachment strap 38 and the cross-bar 34 also permits the buckle 10 to rotate freely about an axis defined by the cross-bar, thereby facilitating ease of manipulation. When the buckle is to be unlatched, a user may press the distal legs 16 towards one another to permit withdrawal of the latch component 12 in a manner as will be well known.

The features of the present disclosure facilitate the replacement of a buckle component by use of a cross-bar 34 which can be readily disengaged from the attachment strap 38 in the event that the buckle component becomes damaged. In this regard, it is to be understood that while the displaceable cross-bar 34 is illustrated and will be described in operative connection to the receiving body 30 of the buckle 10, it is likewise contemplated that the same constructions may alternatively be used on the latch component 12 if desired. By way of example only, in such an alternative construction, the cross-bar 34 could replace the base eyelets 18 and extend between ears forming lateral sides of the latch component proximal base. However, the operation of the cross-bar would be the same.

Figure 2:
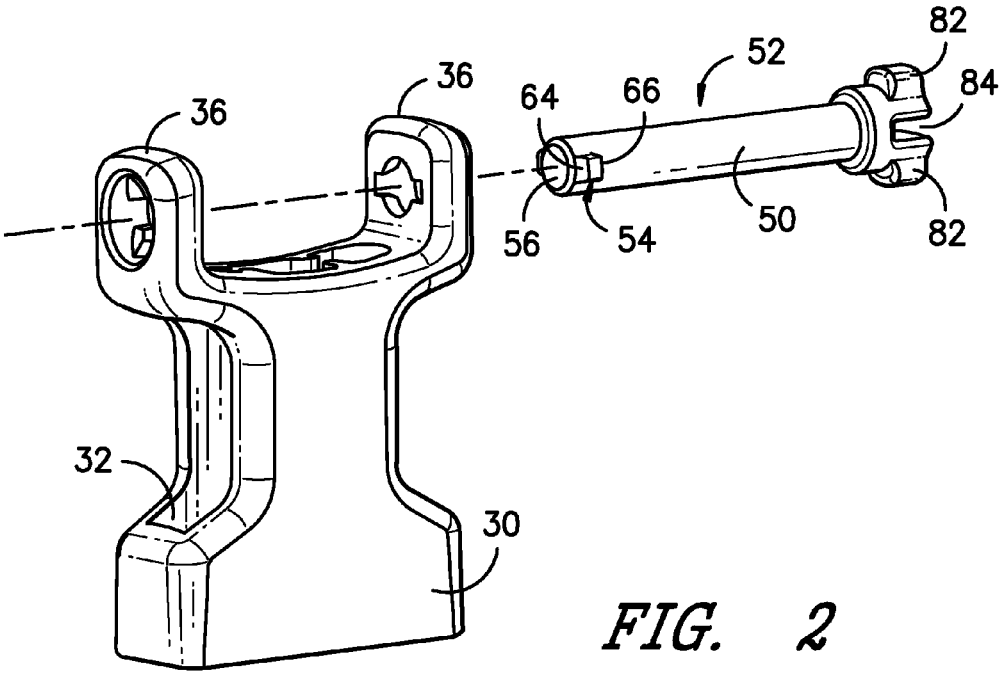
FIG. 2 is a partial assembly view of a first embodiment of a buckle component consistent with the present disclosure adapted for engagement with a webbing loop illustrating a removable cross-bar in the displaced condition.
Figure 3:
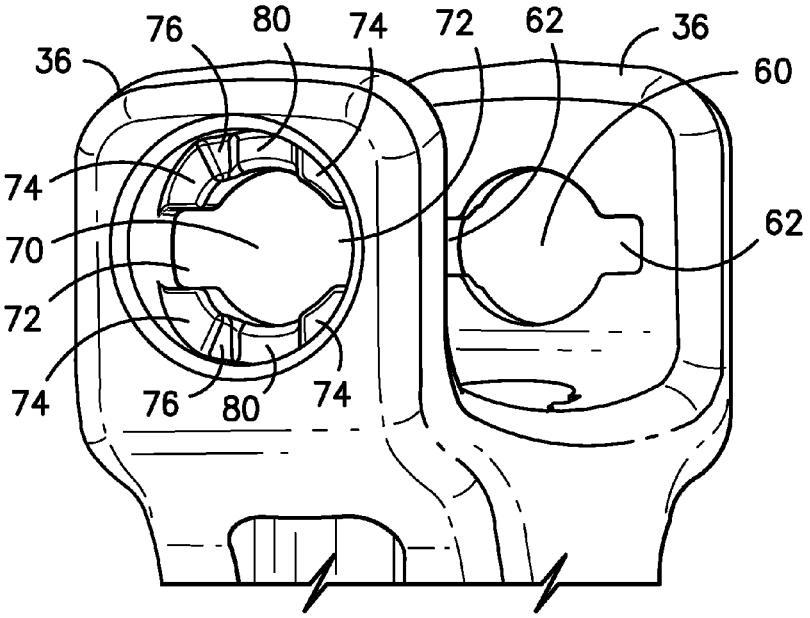
FIG. 3 is a schematic side view illustrating the buckle component of FIG. 2, showing surfaces adapted to hold the removable cross-bar in place after insertion
Figure 4:
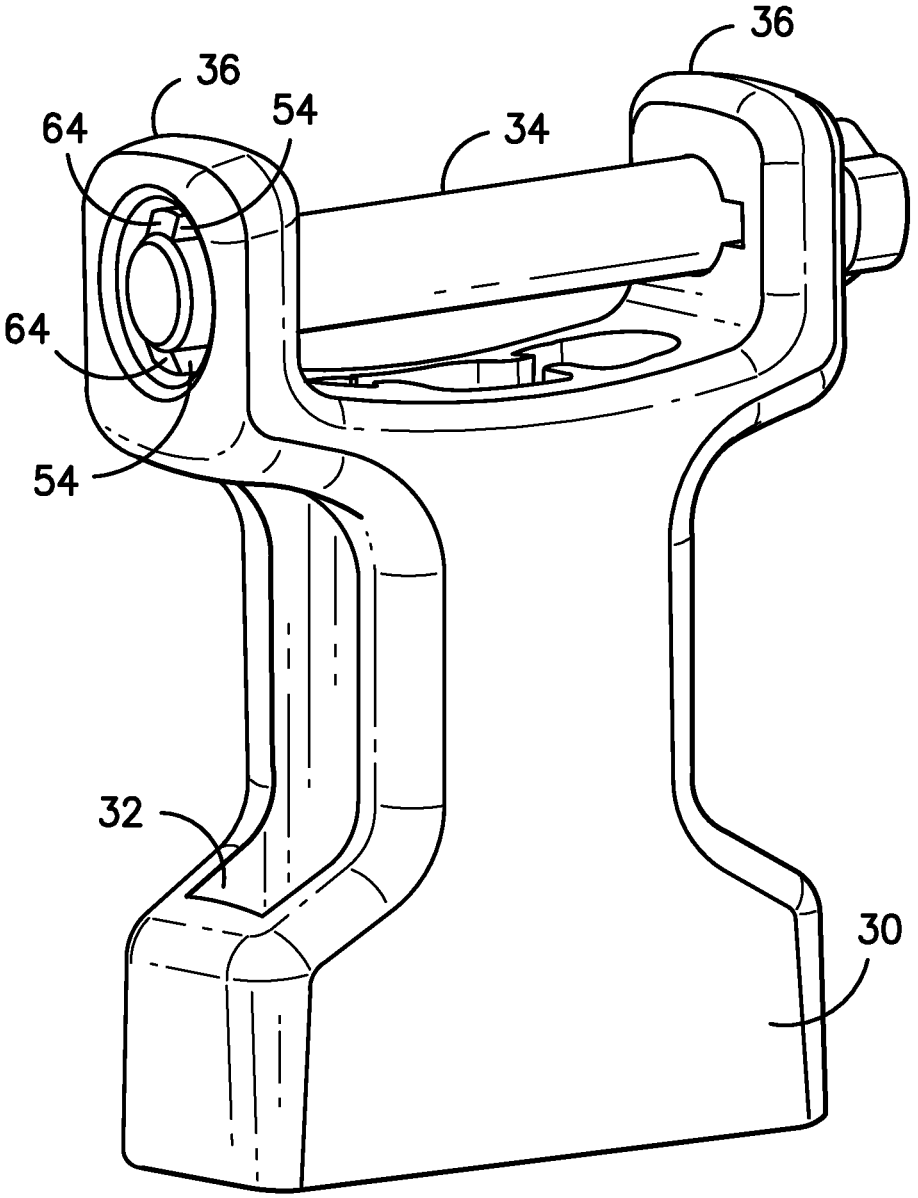
FIG. 4 is a view similar to FIG. 2, illustrating the removable cross-bar in its operative position.

Referring now jointly to FIGS. 2-4, in a first illustrated exemplary construction, the cross-bar 34 is provided by a substantially smooth surface shaft portion 50 of a displaceable pin 52 formed by practices such as injection molding or the like from materials as previously described. By way of example only and not limitation, the displaceable pin 52 may be formed from the same material as the receiving body 30 and/or the latch component 12. However, different materials of construction may also be used if desired. As best seen through joint reference to FIGS. 2 and 4, the displaceable pin 52 may include a pair of lateral posts 54 located adjacent to the distal end 56 of the pin 52. As best seen through joint reference to FIGS. 2 and 3, the distal end 56 of the pin 52 is adapted to be inserted into an entrance opening 60 in the form of a keyed passageway on one of the ears 36 such that the lateral posts 54 are substantially aligned with a pattern of perimeter insert slots 62 extending radially outwardly from opposing sides of a central portion of the entrance opening 60. In accordance with one exemplary practice, the insert slots 62 are slightly undersized relative to the lateral posts 54 to facilitate non-reversible, press-fit insertion. In this regard, the lateral posts 54 may each include a leading face 64 which is slightly chamfered and narrower than a rear face 66 which is substantially planar. This construction defines a generally trapezoidal profile to facilitate press-fit insertion and retention.

In the illustrated exemplary construction, after passing through the entrance opening 60, the distal end 56 of the pin 52 may be inserted through an exit opening 70 defining a keyed passage on the ear 36 opposing the entrance opening. During this insertion through the exit opening 70, the lateral posts 54 are substantially aligned with a pattern of perimeter exit slots 72 on opposing sides of a central portion of the exit opening 70. The perimeter exit slots may be slightly oversized relative to the lateral posts 54 to facilitate unobstructed pass-through when the pin 52 is properly aligned. As will be appreciated, the oversized condition of the exit slots will also prevent locking engagement of the pin 52 within the exit opening 70 in the event that insertion is made from the incorrect side. That is, in the event that the pin 52 is inadvertently inserted from the incorrect side, no locking engagement will take place and the pin 52 may be easily withdrawn for proper insertion through the entrance opening 60.

As shown, in the illustrated exemplary construction, the exterior surface of the exit opening 70 includes a pattern of ramped surfaces adapted to engage the lateral posts 54 after insertion. As best seen in FIG. 3, this pattern includes four extended ramp surfaces 74 of gradual slope positioned immediately adjacent to the exit slots 72. The extended ramp surfaces 74 are characterized by an elevation increase as distance increases away from the exit slots 72. Thus, the highest elevation for each of the extended ramp surfaces 74 is furthest removed from the exit slots 72. The exemplary pattern of ramped surfaces also includes four barrier ramp surfaces 76 of steeper slope than the extended ramp surfaces 74. The barrier ramp surfaces 76 are characterized by an elevation decrease as distance increases away from the exit slots 72. Thus, the lowest elevation for each of the barrier ramp surfaces 76 is furthest removed from the exit slots 72. As shown, the exemplary pattern of ramped surfaces also includes pair of depressed pin recesses 80. Each pin recess is located between a pair of the barrier ramp surfaces 76 and is oriented with a length dimension in transverse relation to the exit slots 72.

Following insertion of the lateral posts 54 through the exit opening, the pin may be rotated by ¼ turn in either direction to cause the lateral posts 54 to be captured within the pin recesses 80. Rotation may be carried out by finger tightening using wings 82 at the proximal end of the pin 52. Alternatively, a tool engagement slot 84 may be used in conjunction with a driving tool such as a screwdriver, coin or the like (not shown). As will be appreciated, during locking rotation, the rear faces 66 of the lateral posts 54 will first move in camming relation over the increasing elevation extended ramp surfaces 74 and will then be guided over the decreasing elevation barrier ramp surfaces 76 for deposit into the pin recesses 80. In this condition with the lateral posts 54 within the pin recesses 80, any substantial rotation is blocked by the relatively steep slope of the barrier ramp surfaces 76. During use, the shaft portion 50 of the pin 54 remains substantially stationary and does not rotate. However, the looped attachment strap 32 nonetheless permits relative rotation between the buckle 10 and the attachment strap 38 about an axis defined substantially by the shaft portion 50.

In the event that the buckle 10 is to be disengaged from the attachment strap 38, the pin 52 may be removed by application of a sufficient torque in either direction to permit the lateral posts 54 to move in a cramming action over the barrier ramp surfaces 76 and the extended ramp surfaces 74 to a position in alignment with the exit slots 72 for withdrawal. As will be appreciated, during this removal operation, a significant initial torque must be applied in order to move the lateral posts away from the pin recesses 80 and over the initial steep slope of the barrier ramp surfaces 76. Thus, inadvertent removal is avoided. However, once the extended ramp surface 74 is reached, the slope actually decreases towards the exit slots 72 thereby urging the pin 52 towards the proper orientation for withdrawal. Once the lateral posts 54 are in alignment with the exit slots 72, the distal end 56 of the pin 52 may be withdrawn from the exit opening 70 and towards the entrance opening 60. Nonetheless, full extraction of the pin 52 will be blocked by the undersized insert slots 62. Thus, the pin 52 cannot be lost.

As will be understood, the ability to insert and withdraw the pin 52 permits the selective engagement and disengagement with a looped attachment strap 38. Thus, the attachment strap 38 may be secured in looped relation to a support structure before establishing an operative connection to the buckle 10. Likewise, after an operative connection is established, that connection may be reversed to replace a buckle component if desired. The operative connection can then be reestablished without any need to disengage the attachment strap 38 from its support structure 40. As will be appreciated, this ability for selective engagement and disengagement promotes significant flexibility of operation.

Figure 5:
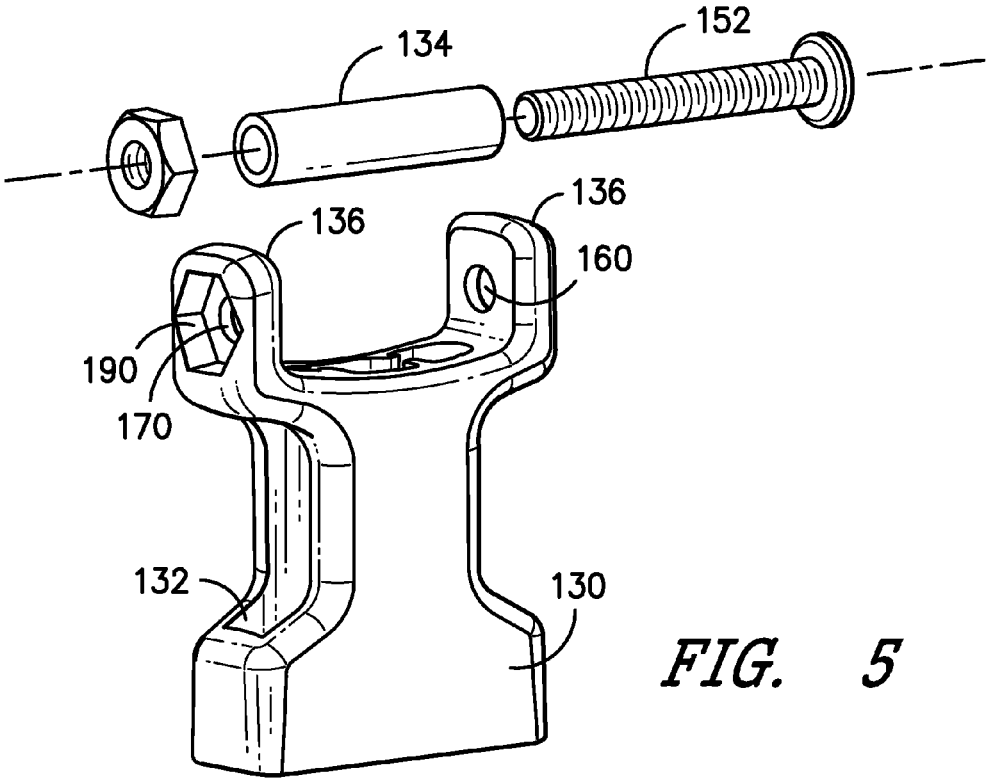
FIG. 5 is a partial assembly view of a second embodiment of a buckle component consistent with the present disclosure adapted for engagement with a webbing loop illustrating a removable cross-bar in the displaced condition.
Figure 6:
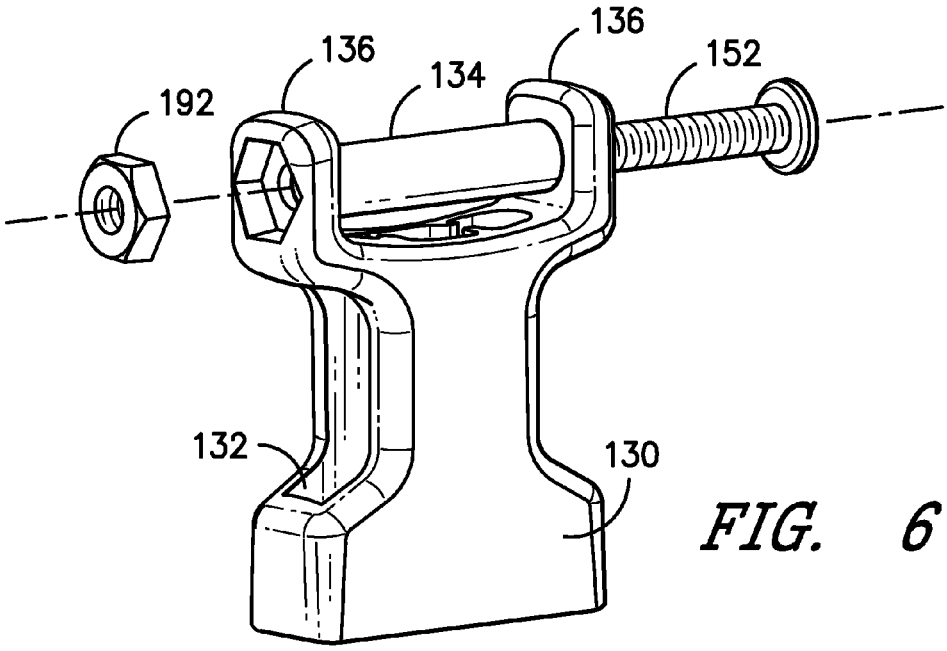
FIG. 6 is a view similar to FIG. 5, illustrating the removable cross-bar in its operative position.

Referring now to FIGS. 5 and 6, an alternative construction for a buckle component consistent with the present disclosure is provided. In FIGS. 5 and 6 all elements corresponding to those described previously and designated by like reference numerals increased by 100. As shown, in this exemplary construction, the hollow receiving body 130 includes a pair of upstanding ears 136 disposed at positions above lateral openings 132 on either side of the receiving body 130. One of the ears 136 includes an entrance opening 160. The other one of the ears includes an exit opening 170.

In the illustrated exemplary embodiment of FIGS. 5 and 6, a displaceable pin in the form of a threaded bolt 152 may pass between the ears 136 in mated relation to the entrance opening 160 and the exit opening 170. A rotatable sleeve 134 defining a cross-bar in inboard relation to the ears 136 is disposed in surrounding relation to the bolt 152. The inner diameter of the rotatable sleeve 134 is greater than the outer diameter of the bolt 152 thereby permitting substantially free rotation of the rotatable sleeve 134 relative to the bolt 152. As illustrated, a nut 192 or other tightening member may be used to secure the bolt 152 in place in spanning relation between the ears 136. In the final connected condition, the nut 192 may be held within a matched recess 190 to avoid inadvertent turning during use.

The receiving body 130 and rotatable sleeve 134 each can be made as individual monolithic structures of plastic formed by injection molding processes, or the like. However, it is likewise contemplated that other materials of construction such as metals or the like may be used to form one or both components if desired. By way of example only, and not limitation, exemplary polymeric construction materials may include Nylon 6, Nylon 6.6 and ABS. However, virtually any other moldable plastic with adequate strength may be used.

The length of the rotatable sleeve 134 is preferably slightly less than the distance between ears 136. As will be appreciated, this slightly shortened distance will facilitate substantially free rotation about the bolt 152. However, it is preferable to avoid substantial exposure of the threads on bolt 152 to avoid undue wear of the surrounding attachment strap (not shown).

As will be readily understood, the bolt 152 with the surrounding rotatable sleeve may be inserted through the loop of an attachment strap to establish the same kind of operative connection illustrated in FIG. 1. The bolt 152 is held in place in by the nut 192, such that rotation of the bolt 152 is prevented. In this condition, the rotatable sleeve 134 is nonetheless able to rotate substantially freely. During use, the looped attachment strap rides on the rotatable sleeve 134 thereby providing substantially free rotation between the buckle and the attachment strap. This operative connection also reduces the likelihood that the attachment strap will cause the bolt 152 to turn during use. After an initial operative connection is established, that connection may be reversed to replace a buckle component if desired. This reversal may be carried out by simply disengaging the bolt 152 from the nut 192 and withdrawing the bolt 152 from the ears 136. The operative connection can then be reestablished by reinsertion of the bolt without any need to disengage the attachment strap from its support structure 40. As will be appreciated, this ability for selective engagement and disengagement promotes significant flexibility of operation.

Variations and modifications of the foregoing are within the scope of the present disclosure. It is understood that the disclosure disclosed and defined herein extends to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

What is claimed is:

1. A buckle assembly comprising: a receiving body component and a latch component adapted for insertion into the receiving body component, wherein at least the receiving body component comprises a first upstanding ear and a second upstanding ear disposed in spaced-apart relation from one another on opposing lateral sides of the receiving body component, each of the first upstanding ear and the second upstanding ear projecting in the direction of insertion of the latch component, wherein the first upstanding ear comprises an entrance opening and the second upstanding ear comprises an exit opening disposed in substantially aligned relation to the entrance opening, wherein the entrance opening and the exit opening each include a pattern of perimeter slots extending away from a central portion to define a keyed passageway, the exit opening having an outboard side comprising a pattern of sloped surfaces of alternating slope and a pair of pin recesses, the pin recesses having a length dimension oriented in transverse relation to the perimeter slots, and wherein a displaceable pin extends matedly through the entrance opening and the exit opening such that the displaceable pin defines a removable cross-bar extending in spanning relation between the first upstanding ear and the second upstanding ear, the displaceable pin comprising a shaft portion including a distal end and plurality of lateral posts disposed adjacent to the distal end, wherein the lateral posts each include a rear face adapted to move in camming action over the sloped surfaces at the outboard side of the exit opening when the displaceable pin is rotated, wherein the displaceable pin is at an elevation such that an attachment strap may be disposed in looped relation to the displaceable pin such that the receiving body component is rotatable relative to the attachment strap.

2. The buckle assembly as recited in claim 1, wherein the displaceable pin further includes a proximal end comprising finger engagement wings.

3. The buckle assembly as recited in claim 1, wherein the displaceable pin further includes a proximal end comprising a tool engaging slot.

4. The buckle assembly as recited in claim 1, wherein the perimeter slots of the entrance opening are smaller than the perimeter slots of the exit opening.

5. The buckle assembly as recited in claim 4, wherein the lateral posts are sized to pass in press-fit, keyed relation through the perimeter slots of the entrance opening and to pass in substantially unobstructed keyed relation through the perimeter slots of the exit opening.

6. The buckle assembly as recited in claim 1, wherein the receiving body component is a monolithic molded plastic structure.

7. The buckle assembly as recited in claim 1, wherein the displaceable pin is a monolithic molded plastic structure.

8. The buckle assembly as recited in claim 1, wherein the receiving body component and the displaceable pin are each molded from a polymeric material selected from the group consisting of Nylon and ABS.

* * * * *